United States Patent [19]

Dunbar et al.

[11] 4,289,471

[45] Sep. 15, 1981

[54] APPARATUS FOR FORMING A SHEET OF DRY WOOD PULP

[75] Inventors: John H. Dunbar, Marlborough; Kenneth L. Gray, Kenilworth, both of England

[73] Assignee: Courtaulds Limited, London, England

[21] Appl. No.: 969,580

[22] Filed: Dec. 14, 1978

[30] Foreign Application Priority Data

Dec. 19, 1977 [GB] United Kingdom .... 52692/77

[51] Int. Cl.[3] ..... B29C 17/10

[52] U.S. Cl. ..... 425/373; 425/405 R

[58] Field of Search ..... 425/363, 373, 405 R

[56] References Cited

U.S. PATENT DOCUMENTS 3,050,427 8/1962 Slayter et al. ..... 264/518

FOREIGN PATENT DOCUMENTS 838649 8/1960 United Kingdom .
845849 8/1960 United Kingdom .
35428 8/1977 United Kingdom .

*Primary Examiner*—Donald E. Czaja

*Assistant Examiner*—James R. Hall

*Attorney, Agent, or Firm*—Davis, Hoxie, Faithful & Hapgood

[57] ABSTRACT

An apparatus for forming a coherent and substantially uniform sheet of dry fibrous material comprises a feed conveyor arranged to receive and convey the fibrous material, a spreader, a collection conveyor positioned to receive and convey fibrous material discharged by the spreader and means for consolidating the fibrous material received by the collection conveyor. The spreader has a first member which comprises an assembly of blades extending across the feed conveyor and rotatable so that the blades at their lowest position are closely adjacent to the feed conveyor and rotate towards the fibrous material on the feed conveyor to lift the fibrous material off the feed conveyor, and a second member positioned so that fibrous material thus lifted off the conveyor is subjected to a fibre-separating action between the first and second members before being discharged from the spreader.

12 Claims, 5 Drawing Figures

APPARATUS FOR FORMING A SHEET OF DRY WOOD PULP

This invention relates to an apparatus for forming substantially dry fibrous material into a coherent and substantially uniform sheet. By fibrous material we mean dry wood pulp or textile fibres. The textile fibres can for example be short staple length textile fibres of up to 30 mm. The invention is applicable for example to producing rolls of pulp with consistent basis weight and density for use in factories making disposable absorbent products, or producing bales of pulp sheets for factories making paper products or producing textile fibre webs for bonding as non-woven fabrics. The invention can also be used to directly produce pulp products such as absorbent pads, paper board and towelling.

According to the invention an apparatus for forming a coherent and substantially uniform sheet of dry fibrous material comprises a feed conveyor arranged to receive and convey the fibrous material, a spreader having a first member which comprises an assembly of blades extending across the feed conveyer and rotatable so that the blades at their lowest position are closely adjacent to the feed conveyor and rotate towards the fibrous material on the feed conveyor to lift the fibrous material off the feed conveyor and a second member positioned so that fibrous material thus lifted off the conveyor is subjected to a fibre-separating action between the first and second members before being discharged from the spreader, a collection conveyor positioned to receive and convey fibrous material so discharged and means for consolidating the fibrous material received by the collection conveyor.

In a preferred embodiment of the invention a single conveyor passing below the spreader acts as both the feed conveyor and the collection conveyor. The spreader lifts the fibrous material off the conveyor and discharges it further along the conveyor. The spreader opens fibre bundles in the pulp and spreads the pulp more evenly across and along the conveyor. Alternatively, two conveyors operating at different speeds can be used. For example if the collection conveyor moves faster than the feed conveyor, the apparatus can produce an even sheet of pulp whose basis weight is less than the average rate at which the pulp is received by the feed conveyor.

The means for consolidating dry wood pulp are generally means for compressing it, for example pressure rolls. The means for consolidating textile fibres can comprise needle-punching apparatus, stitch-bonding apparatus or means for adhesively bonding the textile fibres, which in the case of thermoplastic fibres can be means for applying heat and pressure to the fibres.

Figure 1:
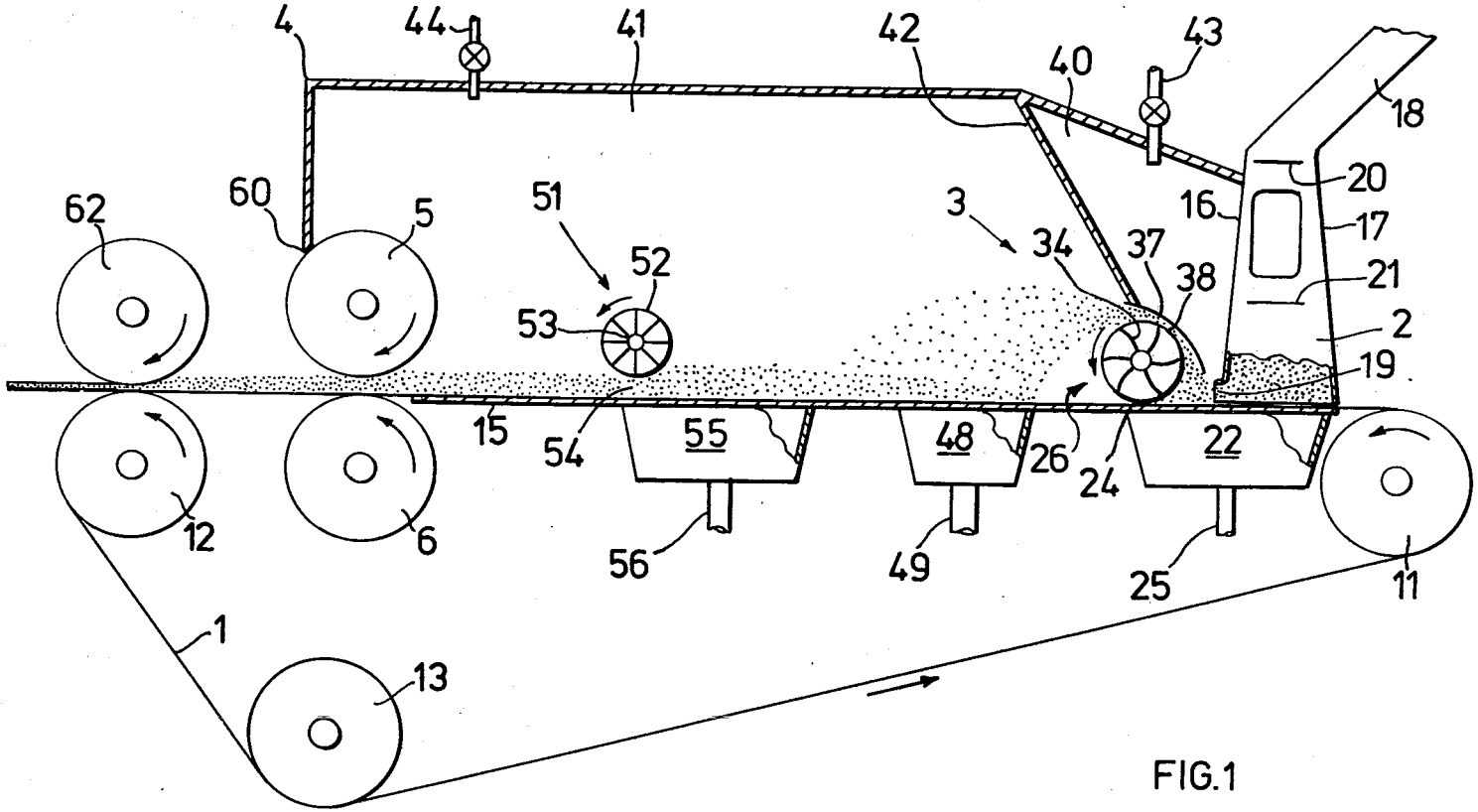
Figure 2:
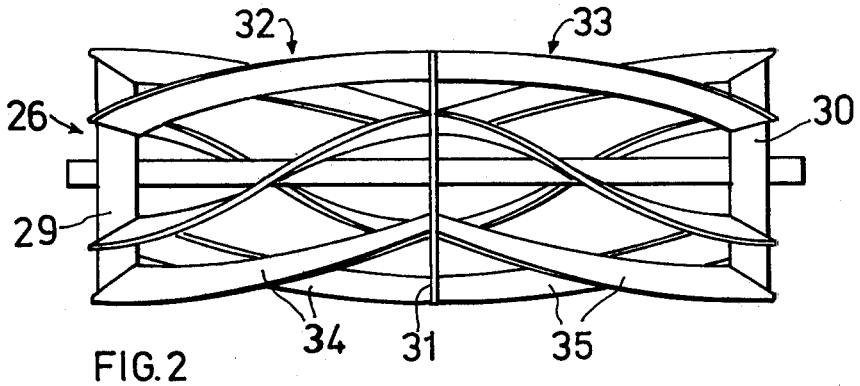
Figure 4:
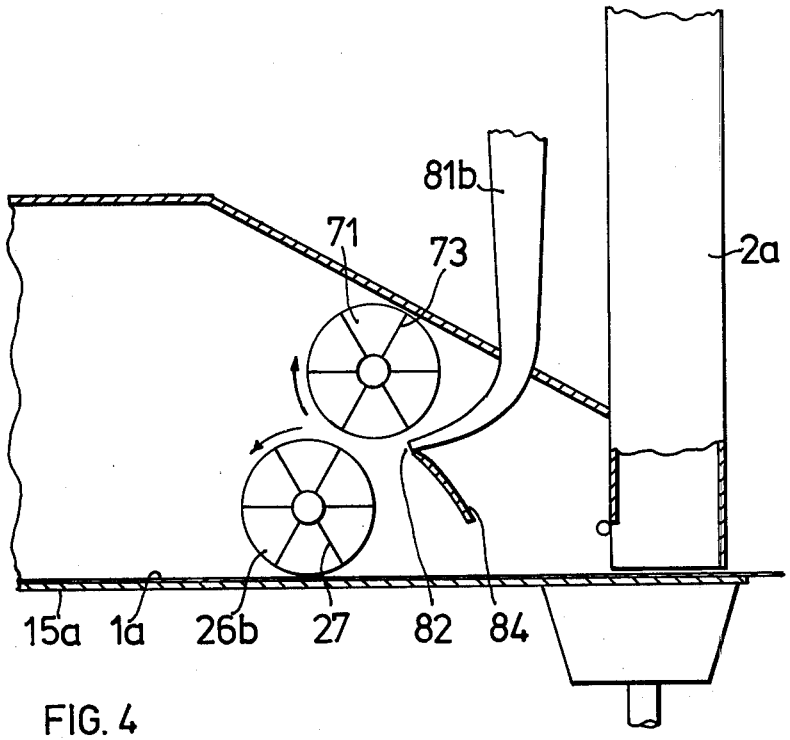
Figure 3:
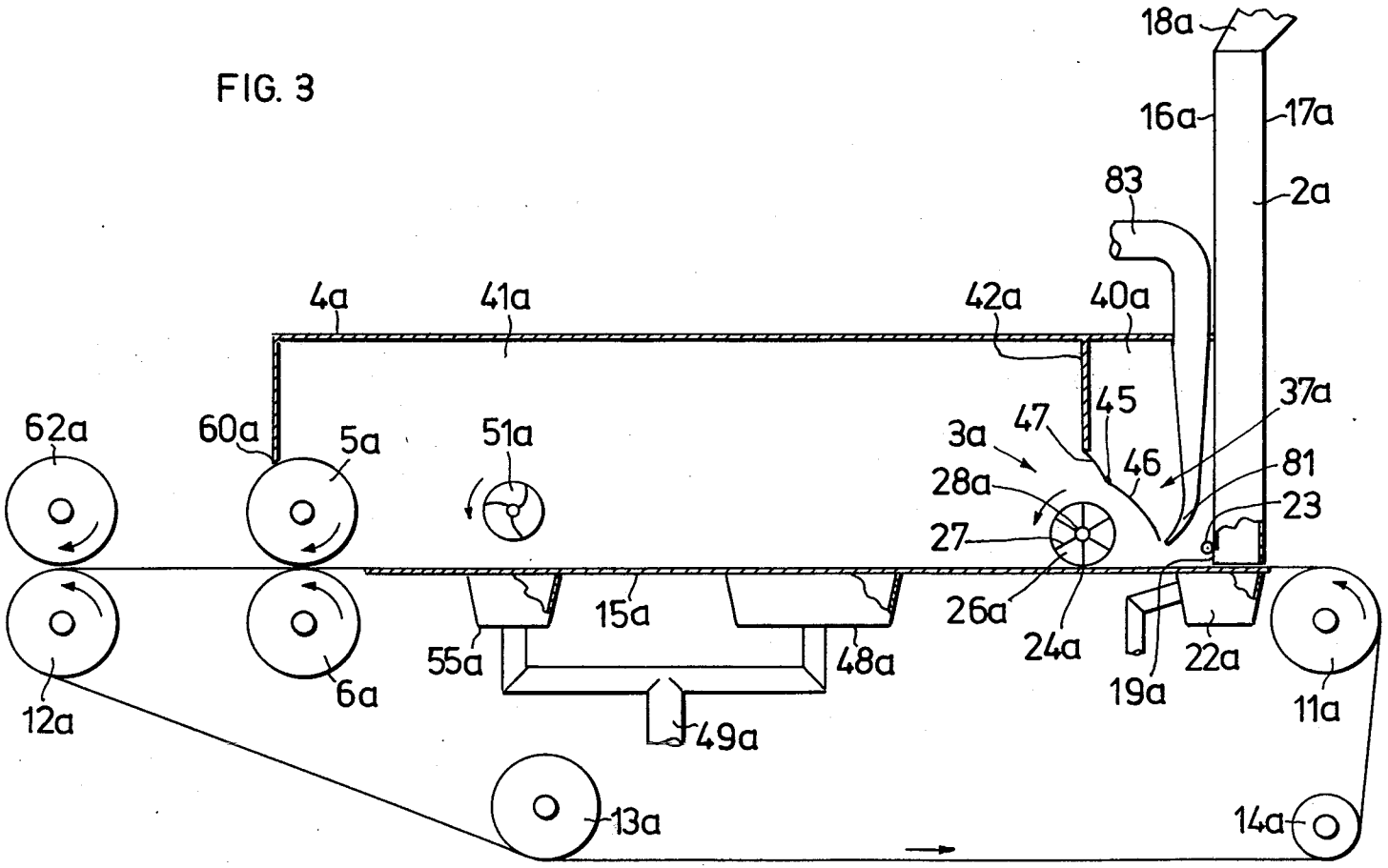
Figure 5:
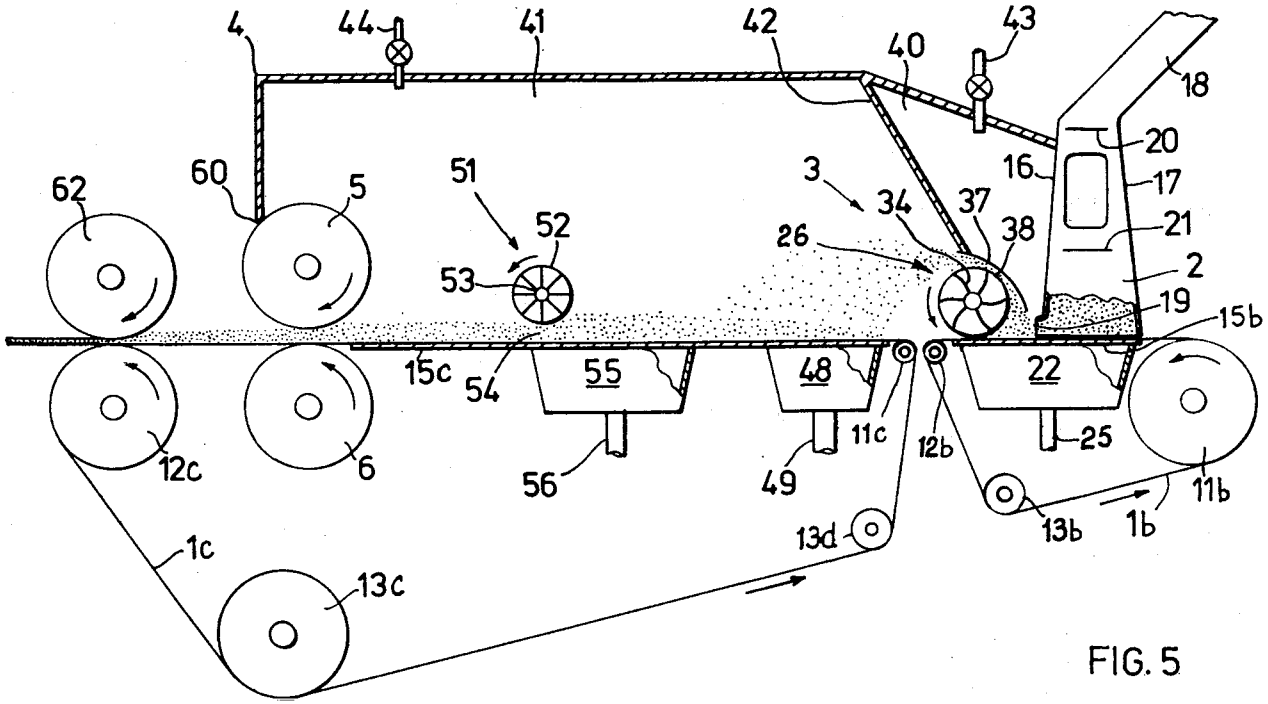

The invention will now be described by way of example with reference to the accompanying drawings, in which:

FIG.1 is a diagrammatic, partially sectioned, side elevation of an apparatus according to the invention for producing a coherent and transportable sheet of wood pulp, FIG. 2 is a rear elevation of the assembly of blades used in the apparatus of FIG. 1, FIG. 3 is a diagrammatic, partially sectioned, side elevation of an alternative apparatus according to the invention, FIG. 4 is a diagrammatic sectional side elevation of part of an alternative apparatus according to the invention, showing the pulp spreader, and FIG. 5 is a diagrammatic, partially sectioned, side elevation of another embodiment of apparatus according to the invention.

The apparatus of FIGS. 1 and 2 comprises generally a conveyor 1 which acts as both feed conveyor and collection conveyor, a hopper 2, a pulp spreader 3, a housing 4 and consolidation rolls 5 and 6.

The conveyor 1 is an air-pervious mesh conveyor of metallic wire or plastics material, for example nylon or polyester monofilament. It moves in the direction shown around rolls 11, 12 and 13. Below the hopper 2, the pulp spreader 3 and the housing 4, the conveyor 1 moves over a stationary air-pervious plate 15.

The hopper 2 is of generally rectangular cross-section having a front wall 16 and a back wall 17. The conveyor 1 acts as the base of the hopper. The hopper 2 is positioned to receive dry wood pulp via a duct 18 which may, for example, lead from a cyclone separator (not shown). The apparatus of the invention can for example be used to form a pulp sheet from dry wood pulp produced by the process of U.S. Patent Application Ser. No. 912,716, filed June 5, 1978 and in common ownership with the present application. The hopper acts as a reservoir of pulp allowing sheet formation to continue during temporary interruptions in the delivery of pulp to the feed conveyor. If a pulp feed of consistent weight per unit time is available, a hopper 2 may not be necessary.

The exit 19 of the hopper 2 is defined by the feed conveyor 1 and the bottom of the front wall 16 of the hopper. The height of the exit 19 determines the average height of the layer of pulp on the feed conveyor 1 as it approaches the spreader 3.

The back wall 17 (or one of the side walls) of the hopper can be formed with a window (not shown) so that the level of wood pulp in the hopper 2 can be observed. Alternatively, the hopper can be fitted with a detecting device (not shown) to determine that the level of the pulp in the hopper stays between desired upper and lower limits 20 and 21.

A suction box 22 is positioned below the air-pervious conveyor 1 and the hopper 2. The suction box 22 extends across the width of the hopper and lengthwise from the back wall 17 of the hopper to the lowest point 24 of a blade assembly 26 in the spreader 3. A duct 25 opening into the suction box 22 communicates with a fan (not shown) arranged to draw air from the hopper 2 through the pulp in the hopper and through the air-pervious conveyor 1 into the suction box 22.

The application of suction through the air-pervious conveyor 1 to the wood pulp in the hopper 2 helps to prevent slipping between the conveyor and the pulp and undesirable sticking or bridging of wood pulp in the hopper and thus to give a consistent feed through the exit 19. The degree of suction applied can be varied, for example, between 1 cm water gauge and 60 cm water gauge. Increased suction holds the wood pulp fibres more tightly against the conveyor 1 forming a more dense mass of fibres on the conveyor. Increased suction thus increases the bulk density of the layer of fibres carried through the exit 19 and hence the weight per unit area (basis weight) of the layer of wood pulp on the feed conveyor 1.

Variations in suction between 1 cm water gauge and 30 cm water gauge can change the basis weight of the layer of wood pulp by a factor of from 1.5 to 2. The height of the exit 19 can be adjusted if pulp sheets of greatly differing basis weights are desired but smaller changes in basis weights can be achieved by using various suction pressures applied y the suction box 22.

Suction is usually applied evenly across the width of the air-pervious conveyor 1 and the hopper 2 but, by varying the size and distribution of the apertures in the air-pervious plate 15 underneath the hopper, suction can be applied unevenly, for example, to give greater suction at the sides of the hopper 2 than at the middle.

The conveyor 1 carries the layer of pulp from the exit 19 of the hopper 2 to the pulp spreader 3. A first member of the spreader 3, in the form of the aforementioned blade assembly 26, comprises a spindle 28 bearing discs between which blades 34, 35 are mounted, as in a lawnmower. The blades just clear the conveyor 1 at their lowest point 24. This first member of pulp spreader 3 can be in various forms so long as it has blades, teeth or hammers capable of exerting a shredding action on the pulp.

The blade assembly 26 used in pulp spreader 3 is shown in more detail in FIG. 2. The spindle 28 carries edge plates 29, 30 and the central disc 31 dividing the assembly into two halves 32 and 33 bearing the blades 34 and 35, respectively. Each blade is helically curved and the blades 34 and 35 are curved in opposite directions to one another. The helical curvature of each set of blades tends to throw the pulp slightly to one side thus counteracting any tendency of the pulp to be thicker at the centre of the conveyor 1.

The second member of the pulp spreader can be stationary or rotatable so long as it is positioned so that pulp lifted off the conveyor 1 by the first member is subjected to an action between the first and second members. In the apparatus of FIGS. 1 and 2, the second member is a deflector plate 37 mounted in such a position that pulp has to pass between the blades 34, 35 and the deflector plate 37 before it is discharged from the spreader in the direction of travel of the conveyor 1. The deflector plate 37 is preferably curved but need not be concentric with the blade assembly 26. The radius of curvature of deflector plate 37 is preferably greater than the radius of the blade assembly so as to define a point 38 where the blades 34, 35 most closely approach the deflector plate 37. To break up agglomerated fibre bundles in the pulp, the distance at 38 between the blades 34, 35 and the deflector plate 37 is generally less than the height of the exit 19 of the hopper 2 which defines the thickness of the pulp layer on the feed conveyor 1.

The preferred speed of rotation of the blade assembly 26 of spreader 3 is from 1000 to 3000 r.p.m. At these high speeds of rotation the blade assembly 26 acts as a fan. We believe that the pulp is mainly blown off the feed conveyor 1 against the deflector plate 37. The stream of air created by the blade assembly 26 separates the pulp fibres, distributes them substantially uniformly in air and conveys them between the blade assembly 26 and deflector plate 37 of the spreader 3. The pulp is held on the conveyor against this air stream by the suction box 22 which extends to a point beneath blade assembly 26.

The housing 4 can be divided into two compartments 40 and 41 by a wall 42 on which the deflector plate 37 is mounted. The compartments 40 and 41 can have air inlets 43 and 44, respectively, to allow the controlled ingress of air.

The pulp spreader 3 throws pulp forwardly into the compartment 41 as a loose fluffy mass. The pulp lands as a layer on the air-pervious conveyor 1. A suction box 48 is positioned below the conveyor 1 and the air-pervious plate 15 in the area where the pulp is intended to fall. The suction box 48 is connected via a duct 49 to a fan (not shown) which draws air from the compartment 41 through the pulp and the air-pervious conveyor 1 into the suction box 48. The suction box 48 is not essential but aids in the formation of a regular layer of pulp and ensures that the atmosphere within the housing 4 is at a lower pressure than the surrounding atmosphere so there is no tendency for pulp fibres to be blown out of the housing 4. The degree of suction applied is preferably sufficient to create a pressure in the suction box 48 of from 5 to 15 cm water gauge below atmosphere.

The pulp thus gathered as a layer above the suction box 48 is carried by the conveyor 1 under a trimming roll 51. This is an assembly of blades 52 mounted on a spindle 53 between two discs in a manner similar to the blades of the blade assembly 26 of the pulp spreader 3. The blades 52 can be parallel to the spindle 53 or biased as shown in FIG. 2. The trimming roll 51 could alternatively be a cylinder carrying radially-extending blades. This alternative is not shown. The trimming roll 51 is mounted so that the blades 52 at their lowest point 54 have a clearance from the conveyor 1 equal to the desired thickness of the pulp layer. If the pulp layer is thicker at any point along its length the blades 52 knock the excess pulp back. The trimming roll 51 thus smooths out any longitudinal variations in the thickness of the pulp layer.

When a trimming roll such as 51 is used, a suction box 55 is preferably mounted below the conveyor 1 and the air-pervious plate 15 in the region approaching the trimming roll 51. The suction box 55 extends up to or a little beyond the lowest point 54 of the trimming roll 51. The suction box 55 is connected by a duct 56 with a fan (not shown) which can conveniently be the same fan as is connected to the duct 49. The suction box 55 holds the pulp on the conveyor 1 against the action of the trimming roll 51. The speed of rotation of the trimming roll 51 is preferably from 50 to 1000 r.p.m. The suction box 55 can also help to control the density of the pulp layer so that the layer of uniform thickness produced by the action of the trimming roll 51 has the desired basis weight.

The pulp layer passes to the consolidation rolls 5, 6 which compress the pulp there. The roll 5 is sealed against the housing 4 at 60. The consolidation rolls compress the pulp so that fibres are not blown off the pulp surface after it leaves the housing but the pulp layer is still supported by the conveyor 1 as it passes to pressure rolls 62 and 12 which compress the pulp layer further into a more coherent sheet. The conveyor 1 separates from the pulp sheet at the roll 12. The pulp sheet can then pass to calender rolls (not shown) where its bulk density and coherence are increased, and can subsequently be reeled or chopped into sheets and stacked in bales.

So long as sufficient pulp is held in the hopper 2 the basis weight of the pulp sheet produced is dependent primarily upon the height of the exit 19 and the pressure applied by means of the suction box 22. The basis weight is generally independent of the speed of the conveyor 1 and this speed can be varied to maintain the level of pulp in the hopper 2 within prescribed limits. The apparatus of FIGS. 1 and 2 can thus form a pulp sheet of consistent basis weight from a somewhat irregular supply of pulp.

The alternative apparatus shown in FIG. 3 comprises many parts which are equivalent to parts used in the apparatus of FIG. 1 and these parts are designated by the same reference numerals as in FIG. 1 but with the addition of a suffix a. Thus the apparatus shown in FIG. 3 comprises generally a air-pervious conveyor 1a which acts as both feed conveyor and collection conveyor, a hopper 2a, a pulp spreader 3a, a housing 4a and consolidation rolls 5a and 6a.

The conveyor 1a moves in the direction shown around rolls 11a, 12a, 13a and 14a. Below the hopper 2a, pulp spreader 3a and housing 4a the conveyor 1a moves over a air-pervious plate 15a.

The hopper 2a is of generally rectangular cross-section having a front wall 16a and a back wall 17a. The conveyor 1a acts as the base of the hopper. The hopper 2a is positioned to receive fibrous material, for example flash dried wood pulp from a cyclone separator, via a duct 18a. At the bottom of the front wall 16a a roller 23 is free to rotate. The exit 19a of the hopper 2a is defined by the conveyor 1a and the roller 23.

A suction box 22a is positioned below the air-pervious plate 15a and the conveyor 1a in the region of the hopper 2a. The suction box 22a extends across the width of the hopper and lengthwise from the back wall 17a of the hopper to beyond the exit 19a of the hopper.

The length of the hopper from the front wall 16a to the back wall 17a is small, for example about three times the height of the exit 19a. Pulp flows down the hopper 2a as a block. It is then held on the conveyor 1a by suction and moves with the conveyor. As the exit 19a the movement of the pulp causes rotation of the roller 23 and this rotation aids in the smooth passage of pulp through the exit 19a. Rotation of the roller 23 carries pulp upwards but the pulp soon falls back under its own weight so that the layer of pulp on the feed conveyor 1a often has ridges extending across the conveyor. The action of the pulp spreader 3a removes these irregularities.

The pulp spreader 3a consists of a first member in the form of a fan 26a and a second member in the form of a deflector plate 37a. The fan 26a has a hub 28a and radially-extending blades 27 which just clear the conveyor 1a at their lowest point 24a. The deflector plate 37a comprises two curved plates 46 and 47 connected at 45. For example, the plates 46 and 47 can be hinged at 45 to allow adjustment of the deflector plate. As the pulp is blown off the conveyor by the fan 26a it encounters the lower curved plate 46 of the deflector 37a. The suspension of pulp fibres in turbulent air is constrained to a convergent path between the fan 26a and the curved plate 46 up to the point at which the deflector 37a most nearly approaches the fan 26a which is contained at or near 45. The path of the pulp and air is divergent between the fan 26a and the upper curved plate 47 of the deflector 37a, allowing the pulp fibres to be thrown forwardly as a loose fluffy mass.

The fan 26a needs to draw in large amounts of air to suspend the wood pulp fibres in air. The spreader 3a is provided with an air injection nozzle 81 which injects air at superatmospheric pressure below the deflector 37a in a downwardly and forwardly direction. This aids in the break-up of fibre bundles in the pulp and increases the distance over which the spreader 3a discharges the pulp, thus allowing the evening out of greater irregularities in the pulp feed.

The housing 4a is divided into two compartments 40a and 41a by a wall 42a on which the upper part 47 of the deflector 37a can be mounted. The pulp spreader 3a throws pulp forwardly into the compartment 41a as a loose fluffy mass which lies on the conveyor 1a. A suction box 48a is positioned below the conveyor 1a and the air-pervious plate 15a in the area where the pulp falls. The pulp thus gathered as a layer above the suction box 48a is carried by the conveyor 1a under a trimming roll 51a which is a rotatable assembly of blades. The blades can be radially-extending blades mounted on the hub or blades mounted between two discs either perpendicular to the direction of travel of the conveyor 1a or helically mounted as shown in FIG. 2. A suction box 55a is mounted below the air-pervious plate 15a and conveyor 1a in the region approaching the trimming roll 51a. The suction boxes 48a and 55a are both connected to a duct 49a through which a suction of, for example, 5 cm water gauge can be applied. The air thus removed can be recycled through a pipe 83 to the air injection nozzle 81.

The pulp layer passes to the consolidation rolls 5a and 6a which compress the pulp. Roll 5a is sealed against the housing 4a and 60a. The compressed pulp passes to further pressure rolls at 62a and 12a which compress the pulp further into a more coherent sheet. The conveyor 1a separates from the pulp sheet at the roll 12a.

FIG. 4 shows an alternative form of pulp spreader for use in the apparatus of FIG. 3. In FIG. 4 those parts which are equivalent to parts used in the apparatus of FIG. 1 have been designated with the same reference numerals as in FIG. 1 but with the addition of a suffix b. The spreader of FIG. 4 comprises first and second members in the form of fans 26b and 71, respectively, both fans having radially-extending blades 27 and 73, respectively. The fans are mounted with their axes of rotation horizontal and the line joining the axes is preferably at about 60° to the horizontal. An air injection nozzle 81b injects air at 82 into the gap between the fans 26b and 71. A deflector plate 84 is mounted below the air nozzle 81b.

In use, fibrous material, such as wood pulp, is carried by the feed conveyor 1a from the hopper 2a to the spreader. The pulp is blown off the conveyor 1a by the action of the fan 26b. The deflector plate 84 prevents the pulp being blown backwardly away from the spreader and the air from the nozzle 81 urges the pulp to pass between the fans 26b and 71. The fan 71 rotates in the direction shown at a slower speed than the fan 26b.

Pulp discharged by the spreader is collected on the conveyor 1a passing over a air-pervious plate 15a and suction box, as in the apparatus of FIG. 3.

The apparatus of FIGS. 1, 3 and 4 can each form a pulp sheet of consistent basis weight from a somewhat irregular supply of pulp. The pulp sheet produced can for example have any desired basis weight in the range of from 50 to 3000 g/m$^2$ and can be formed at speeds of up to 100 m/minute.

While the pulp sheet recovered from the pressure rolls 62 and 12 or 62a and 12a is a coherent and substantially uniform sheet suitable for use as a pulp sheet feedstock, for example, in a factory making absorbent products, the pulp sheet can be subjected to a further consolidation step (not shown). The pulp can be treated directly in a high pressure calender or alternatively water can be applied to at least one surface of the pulp sheet and the sheet can then be further consolidated by pressure. The amount of water added is preferably from 5 to 20 percent by weight based on the consolidated pulp sheet. The addition of water is particularly valuable in forming paperboard. Some of the advantages of a wet laid sheet, such as increased fibre bonding and a smoother surface, can be achieved without any need for the expensive machinery needed to dry wet laid pulp sheet. The concentration of water at the surface of the pulp sheet is generally higher than that at the centre if the pulp sheet passes straight to the further consilidation step. For example if 10 percent by weight of water is applied to the pulp sheet at the surface, the concentration of water at the surface may be from 20 to 30 percent by weight at the time of pressing. The benefit of increased moisture content at the surface to give a smoother finish can thus be achieved from only a small addition of water based on the total weight of the sheet. The moisture content of the dry wood pulp during the spreading process can be very low, for example from 2 to 8 percent by weight, if water is to be applied to the surface of the pulp sheet.

An alternative position for the addition of water is between the consolidation rolls 5 and 6 and pressure rolls 62 and 12 of FIG. 1, or between consolidation rolls 5*a* and 6*a* and pressure rolls 62*a* and 12*a* of FIG. 3.

Fibrous or powdered additives, for example a potentially adhesive thermoplastics material such as polypropylene fibres, can be incorporated by metering them into the hopper 2 of FIG. 1 or 2*a* of FIG. 3 or into compartment 40 of FIG. 1. The action of the pulp spreader distributes the additive evenly throughout the pulp layer. Alternatively, an additive can be applied to one side of the pulp sheet. For example, a powdered thermoplastics material, for example polyethylene, can be applied from a dispenser extending across the width of the feed conveyor within the compartment 41 of FIG. 1 or 41*a* of FIG. 3 to form a potentially adhesive layer at one surface of the pulp sheet produced. The pulp and additive can then be pressed into a coated paperboard by passing through heated nip rollers or through a cabinet where it is heated and where the water content may be increased, for example by steam, prior to pressing.

FIG. 5 shows another embodiment of apparatus according to the invention. The apparatus of FIG. 5 is a modified form of the apparatus of FIGS. 1 and 2, in which the air-pervious conveyor 1 of FIG. 1 is replaced by two air-pervious conveyors, namely a conveyor 1*b* acting as the feed conveyor and a conveyor 1*c* acting as the collection conveyor. The conveyor 1*b* is mounted on rolls 11*b*, 12*b* and 13*b*, and the conveyor 1*c* is mounted on rolls 11*c*, 12*c*, 13*c* and 13*d*. The air-pervious plate 15 of the apparatus of FIG. 1 is replaced, in the apparatus of FIG. 5, by two stationary air-pervious plates 15*b* and 15*c* over which move the upper flights of the conveyors 1*b* and 1*c*, respectively. In all other respects the apparatus of FIG. 5 is the same as the apparatus of FIGS. 1 and 2, and like parts of the two apparatus have been designated with the same reference numerals.

What is claimed is:

1. An apparatus for forming a coherent and substantially uniform sheet of dry wood pulp comprising:

(a) feed conveying means arranged to receive and convey the wood pulp as a layer, (b) a spreader having (i) a first member which comprises an assembly of blades extending across the feed conveying means and rotatable so that the blades at their lowest position are closely adjacent to the feed conveying means and rotate towards the wood pulp on the feed conveying means at a speed sufficient to blow the wood pulp off the feed conveying means and to suspend the wood pulp in air and (ii) a second member positioned so that the wood pulp thus suspended in air has to pass between the first and second members before being discharged from the spreader and is subjected to a fiber-separating action between the said first and second members, (c) collection conveying means positioned to receive and convey the wood pulp discharged from the spreader, and (d) means for consolidating the wood pulp received by the collection conveying means to form a coherent and uniform sheet.

2. The apparatus of claim 1 wherein a single conveyor passing below the spreader acts as both the feed conveying means and the collection conveying means.

3. The apparatus of claim 1 wherein the feed conveying means and the collection conveying means are separate conveyors, and the collection conveying means moves faster than the feed conveying means.

4. The apparatus of claim 1 wherein the feed conveying means is an air-pervious feed conveyor and suction means are arranged below the feed conveyor to draw air through the layer of wood pulp on the feed conveyor.

5. The apparatus of claim 1 wherein the collection conveying means is an air-pervious collection conveyor and suction means are positioned below the collection conveyor in the area where the spreader discharges wood pulp onto the collection conveyor.

6. The apparatus of claim 1 wherein the said first member of the spreader is a fan comprising a hub with radially-extending blades.

7. The apparatus of claim 1 wherein said first member of the spreader comprises blades substantially perpendicular to the direction of movement of the feed conveying means mounted between discs arranged substantially parallel to the direction of movement of the feed conveying means.

8. The apparatus of claim 1 wherein said second member of the spreader comprises a deflector plate mounted in such a position that the wood pulp has to pass between the said first member and the deflector plate before it is discharged from the spreader.

9. The apparatus of claim 8 wherein the deflector plate comprises two curved plates joined to one another and positioned so that their junction is in the region of the deflector plate closest to the said first member.

10. The apparatus of claim 1 additionally comprising means for injecting air at superatmospheric pressure under the deflector plate in a downwards and forwards direction.

11. The apparatus of claim 1 additionally comprising a second assembly of blades extending across the collection conveying means and rotatable so that its blades at their lowest point rotate towards the wood pulp on the collection conveying means and have a clearance from the collection conveying means equal to a desired thickness for the layer of wood pulp on the collection conveying means.

12. The apparatus of claim 1 wherein the means for consolidating the wood pulp comprise pressure rolls.

* * * * *